US006001797A

United States Patent [19]

Ewbank et al.

[11] Patent Number: 6,001,797

[45] **Date of Patent: *Dec. 14, 1999**

[54] LIQUID FABRIC SOFTENING COMPOSITIONS CONTAINING A FATTY ALCOHOL ETHOXYLATE DIURETHANE POLYMER AS A THICKENER

[75] Inventors: Eric Ewbank, Kraainem; Catherine Collard, Adenne; Dominique Tummers, Seraing; Ericka Breuer, Grace-Hollogne; Eric Thibert, Herve, all of Belgium

[73] Assignee: Colgate-Palmolive Co., New York, N.Y.

[ * ] Notice: This patent is subject to a terminal disclaimer.

[21] Appl. No.: 09/159,359

[22] Filed: Sep. 23, 1998

Related U.S. Application Data

[63] Continuation-in-part of application No. 09/119,514, Jul. 20, 1998.

[51] Int. Cl.[6] ..... C11D 3/37

[52] U.S. Cl. ..... 510/475; 510/515

[58] Field of Search ..... 510/423, 475, 510/504, 515

[56] References Cited

U.S. PATENT DOCUMENTS

| | | | |
|---|---|---|---|
| 4,079,028 | 3/1978 | Emmons et al. | 260/29.6 NR |
| 4,155,892 | 5/1979 | Emmons et al. | 260/29.2 TN |
| 5,501,806 | 3/1996 | Farooq et al. | 252/8.8 |
| 5,525,245 | 6/1996 | Grandmaire et al. | 252/8.8 |
| 5,534,182 | 7/1996 | Kirk et al. | 8/137 |
| 5,808,131 | 9/1998 | Gruenbauer et al. | 560/25 |

FOREIGN PATENT DOCUMENTS

| | | |
|---|---|---|
| 260430 A2 | 3/1988 | European Pat. Off. . |
| 300240 B1 | 1/1989 | European Pat. Off. . |

*Primary Examiner*—Yogendra Gupta
*Assistant Examiner*—John R. Hardee
*Attorney, Agent, or Firm*—Bernard Lieberman

[57] ABSTRACT

A stable, pourable and water dispersible liquid fabric softening composition is provided comprising (a) from about 2% to about 25% of one or more fabric softening compounds selected from among quaternary ammonium compounds and amine compounds; (b) from 0 to about 10% of a co-softening ingredient; and (c) from about 0.02% to about 3% of a defined fatty alcohol ethoxylate-diurethane polymer as a thickener to provide commercially desirable viscosities without adversely affecting the physical stability of the composition. The balance of the composition is comprised of water and optional ingredients such as an acid, an emulsifier and adjuvants.

6 Claims, No Drawings

LIQUID FABRIC SOFTENING COMPOSITIONS CONTAINING A FATTY ALCOHOL ETHOXYLATE DIURETHANE POLYMER AS A THICKENER

This application is a continuation-in-part of copending U.S. application Ser. No. 09/119,514 filed Jul. 20, 1998, the disclosure of which is incorporated herein by reference.

FIELD OF THE INVENTION

This invention relates to liquid fabric softening compositions and to a process for treating fabrics therewith. More particularly, the invention relates to fabric softening compositions which comprise an effective amount of a fatty alcohol ethoxylate-diurethane polymer as herein defined to thicken the composition to a commercially desirable viscosity without adversely affecting the physical stability of the composition over long-term storage, even at highly acidic pH conditions.

BACKGROUND OF THE INVENTION

Aqueous compositions containing cationic quaternary ammonium compounds or imidazolinium compounds having at least one long chain hydrocarbyl group, or combinations of quaternary ammonium compounds with certain fatty amidotertiary amines in the form of a protonated complex are well recognized in the art to provide fabric softening benefits in a laundry rinse operation.

Achieving a commercially desirable viscosity in such fabric softening compositions has been the focus of much attention in the patent literature. The viscosity of a softening liquid is clearly an important factor for both the product manufacturer as well as the consumer. For the consumer, the cream-like quality of a fabric softening liquid is associated with concepts of softness and mildness. On the other hand, if a liquid product is unduly viscous, dispensing problems in the washing machine may result. Consequently, product acceptance by consumers is often dependent on the manufacturer being able to provide a desirable and stable product viscosity which allows convenient handling and pourability by the consumer.

U.S. Pat. No. 4,379,059 describes a process for the manufacture of a shear thinning fabric softener wherein the softening composition is thickened with polymeric thickeners, such as polyvinylacetate, polyacrylamide and mixtures of guar gum with xanthan gum.

EP 331237 describes an aqueous fabric conditioning composition comprising a fabric softener and a hydrophobically modified nonionic cellulose ether.

EP 385749 describes aqueous fabric conditioning compositions containing as a thickener a hydrophobically modified nonionic polymer having a hydrophobic backbone and at least two hydrophobic groups per molecule attached to the backbone. Described in particular are (i) copolymers of ethylene oxide and/or propylene oxide with small amounts of $C_8$–$C_{24}$ side chains; (ii) hydrophobically modified poly (ethylene oxide and/or propylene oxide/urethanes); and (iii) alkyl substituted poly(vinyl) alcohols.

U.S. Pat. No. 5,310,851 describes polymeric thickeners which are polyurethanes. Among the intended applications for such polymeric thickening there are described latex paints and paper coating compositions. The use of the described polymers in a fabric finishing composition is said to promote softening effects (Col. 6, lines 40–42).

Notwithstanding the availability of numerous commercial thickeners for fabric softening liquid compositions, there remains a need in the art for a thickener capable of being efficaceous in highly concentrated fabric compositions as well as capable of maintaining its stability in low pH softening compositions which are acidified by mineral or polycarboxylic acids.

SUMMARY OF THE INVENTION

The present invention provides a stable, pourable and water-dispersible liquid fabric softening composition comprising:

(a) from about 2% to about 25%, by weight, of one or more fabric softening compounds selected from the group consisting of quaternary ammonium compounds and amine compounds;

(b) from 0% to about 10% of a co-softening ingredient selected from the group consisting of glycerol esters, sorbitan esters and fatty alcohols;

(c) from about 0.02% to about 3%, by weight, of a fatty alcohol ethoxylate-diurethane polymer having the structure of formula (I): (I)

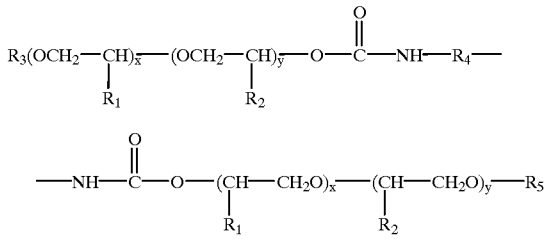

wherein $R_1$ and $R_2$ are independently H, methyl or ethyl; x and y are integers from 0 to 250 with the proviso that x+y is no greater than 250; $R_3$ and $R_5$ are each independently an alkyl or an alkenyl group having from 8 to 24 carbon atoms; and $R_4$ is a linear or branched alkyl, cycloalkyl or aryl group having from 2 to 16 carbon atoms;

(d) from 0% to about 15%, by weight, of an organic or inorganic acid;

(e) from 0% to about 3%, by weight, of an emulsifier selected from the group consisting of alkoxylated fatty alcohols;

(f) from 0% to about 7%, by weight, of one or more adjuvant materials; and (g) balance water, wherein the viscosity of said liquid fabric softening composition is significantly higher than the viscosity of an otherwise identical softening composition but which does not contain the polymer component (c).

The present invention is predicated on the discovery that the incorporation of a fatty alcohol ethoxylate-diurethane polymer as herein claimed in an aqueous fabric softener composition increases the viscosity of the resulting composition to provide commercially desirable viscosities in the range of about 100–1000 cPs, and more preferably about 100–600 cPs such that the final composition is readily pourable without adversely affecting product stability. This viscosity increase can be accomplished over a wide range of softener concentration including highly concentrated compositions and over a wide range of product pH including low pH compositions of about 2.5 or lower, which may result from the introduction of strong or weak acids into the aqueous phase. This type of diurethane polymer is able to function in low pH, acidic compositions where conventional polymeric thickeners are generally inoperative.

Although the applicants do not wish their invention to be restricted by any theory of operation, it is believed that the polymeric thickeners as herein described function as cross-linking materials between individual surfactant structures in aqueous medium. Thus, the increase in product viscosity is believed to be due to the formation of lipophilic bridges between various cationic surfactant structures. Polymers which manifest this type of Theological behavior are termed in the art associative thickeners.

The preferred polymeric thickeners for use herein are sold by BASF under the code names 71495; 71496; and 71497. The various code names refer to different solvent systems for the active polymers. For example, code name 71495 is a 50% active system of polymer in water/isopropanol (3:2 weight ratio); code name 71496 refers to a 25% active solution of polymer in a solvent system of water/butyl diglycol (80:20); and code name 71497 refers to a 25% active polymer in water/propane-1.2-diol/isopropanol.

DETAILED DESCRIPTION OF THE INVENTION

The associative polymers of the invention which are used to effectively thicken fabric softening compositions are fatty alcohol ethoxylate-diurethane polymers having the structure described in Formula I above. In a preferred embodiment, $R_1$ and $R_2$ are H; $R_3$ and $R_5$ are each independently an alkyl or an alkenyl group having from 12 to 18 carbon atoms; $R_4$ is a linear alkyl group having 2 to 10 carbon atoms, more preferably 4 to 8 carbon atoms, and most preferably 6 carbon atoms; and the value of x+y is on average from about 50 to 150.

Depending upon the viscosity required and the nature of the cationic softening compound used, the level of polymer in the softening composition will generally vary from about 0.02 to 3.0%, by weight, and preferably from about 0.05 to 1.5%, by weight of the composition.

The fatty alcohol ethoxylate diurethane polymers of the invention are prepared by condensation of a polyisocyanate, a polyether polyol and a monofunctional capping agent such as a fatty alcohol under substantially anhydrous conditions.

The polyisocyanate used for the preparation of the polymer is preferably a diisocyanate. Higher functionality polyisocyanates may also be used, but only in minor amounts relative to the diisocyanate compound in order to limit the crosslinking reaction between polymer chains which may result in the production of an insoluble gel which is unsuitable for the purposes of this invention.

Suitable diisocyanates may be aliphatic, cycloaliphatic or aromatic such as the following:

1,4 tetramethylene diisocyanate
1,6 hexamethylene diisocyanate
1,8 octamethylene diisocyanate
1,10 decamethylene diisocyanate
1,4 cyclohexylene diisocyanate
2,2,4-tri methyl-1,6-diisocyanatohexane
4,4'-methylene-bis(isocyanatocyclohexane)
1-isocyanato-3-isocyanatomethyl-3,5,5-trimethylcyclohexane
2,6 and 2,4-tolylene diisocyanate
1,3 and 1,4-phenylene diisocyanate
xylene diisocyanate
4,4'-biphenylene diisocyanate
4,4'-methylene diphenylisocyanate A variety of useful polyisocyanates are also mentioned in "Advances in Urethane Science and Technology", K. S. Firsch and S. L. Reegan, editors, Technomic Publishing Company Inc., Volume 1 (1971) and Volume 2 (1973).

Mixtures of 2 or more of the above mentioned diisocyanates are also suitable for the synthesis of the thickener .

The polyether polyol is generally selected from among compounds such as polyethylene glycol and ethylene oxide-propylene oxide block polymer. Preferred polyether polyols are polyethylene glycol having an average molecular weight ranging from 800 to 12,000. More preferred are polyethylene glycol with an average molecular weight from about 1,500 to about 8,000.

The monofunctional capping agent is typically a fatty alcohol such as decanol, dodecanol, tetradecanol, hexadecanol, octadecanol and their blends such as those derived from the natural sources of fatty alkyl compounds.

The fabric softening compound which is useful in the compositions of the invention is a fabric substantive quaternary ammonium compound or an amine compound suitable for conditioning fabrics.

A prefer red softening compound is a biodegradable fatty ester quaternary ammonium compound of Formula II:

(II)

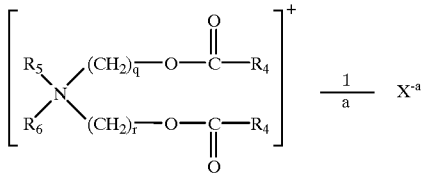

wherein each $R_4$ independently represents an aliphatic hydrocarbon group having from 8 to 22 carbon atoms, $R_5$ represents $(CH_2)_s$–$R_7$ where $R_7$ represents an alkoxy carbonyl group containing from 8 to 22 carbon atoms, benzyl, phenyl, $(C_1$–$C_4)$-alkyl substituted phenyl, OH or H; $R_6$ represents $(CH_2)t$ $R_8$ where $R_8$ represents benzyl, phenyl, $(C_1$–$C_4)$ alkyl substituted phenyl, OH or H; q, r, s and t, each independently, represent a number of from 1 to 3; and x is an anion of valence a.

The fatty ester quaternary compounds are preferably diester compounds, i.e. $R_7$ represents benzyl, phenyl, phenyl substituted by $C_1$–$C_4$ alkyl, hydroxyl (OH) or hydrogen (H). Most preferably $R_7$ represent OH or H, especially preferably OH, e.g. $R_5$ is hydroxyethyl.

q, r and s, each, independently, represents a number of from 1 to 3.

X represents a counter ion of valence a. For example, the diester quat may be a compound of the formula:

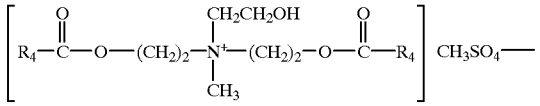

where each $R_4$ may be, for example, derived from hard or soft tallow, coco, stearyl, oleyl, and the like. Such compounds are commercially available, for example, Tetranyl AT1-75, from Kao Corp. Japan, which is di-tallow ester triethanol amine quaternary ammonium methyl sulfate. Tetranyl AT1 -75 is based on a mixture of about 25% hard tallow and about 75% soft tallow. A second example would be Hipochem X-89107, from High Point Chemical Corporation.

Another preferred fabric softening compound is an amido (or ester) tertiary amine which is an inorganic or organic acid salt of Formula (III):

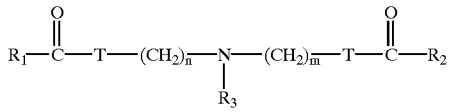

(III)

wherein $R_1$ and $R_2$ independently represent $C_{12}$ to $C_{30}$ aliphatic hydrocarbon groups, $R_3$ represents $(CH_2CH_2O)pH$, $CH_3$ or H; T represents NH; n is an integer from 1 to 5, m is an integer from 1 to 5, and p=1 to 10.

$R_3$ in formula (III) represents $(CH_2CH_2O)pH$, $CH_3$, or H, or mixtures thereof. When $R_3$ represents the preferred $(CH_2CH_2O)pH$ group, p is a positive number representing the average degree of ethoxylation, and is preferably from 1 to 10, especially 1.4 to 6, and more preferably from about 1.5 to 4, and most preferably, from 1.5 to 3.0. n and m are integers of from 1 to 5, preferably 1 to 3, especially 2. The compounds of formula (III) in which $R_3$ represents the preferred $(CH_2CH_2O)pH$ group are broadly referred to herein as ethoxylated amidoamines (when T=NH) or ethoxylated ester amines (when T=O), and the term "hydroxyethyl" is also used to describe the $(CH_2CH_2O)pH$ group.

Most especially preferred is the compound of formula (III) which is commercially available under the tradenames Varisoft 512 (a 90% concentration with a 10% organic solvent), or Varisoft 511 (approximately a 100% active ingredient concentration), available from Witco Chemical Company, which is bis(tallow-amidoethyl)-hydroxyethyl amine of the following formula

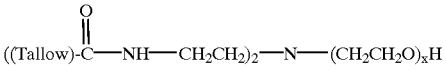

(X=X 1.5 to 3.0)

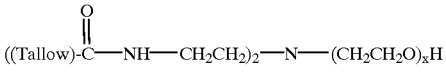

(X = X 1.5 to 3.0)

In the non-neutralized (non-protonated) form the fatty amide or fatty ester tertiary amine compounds are hardly or not at all dispersible in water. Therefore, in the present invention, the amine function of the amidoamine or ester amine compound is at least partially neutralized by a proton contributed by a dissociable acid, which may be inorganic, e.g., HCl, $H_2SO_4$, $HNO_3$, etc. or organic, e.g. acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid used will depend on the "strength" of the acid; strong acids such as HCl, and $H_2SO_4$ completely dissociate in water, and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least an 0.5:1 molar ratio, and up to about a 1:1 molar ratio of the acid to the total amount of fabric softener fatty amide or ester tertiary amine. For the organic carboxylic acids, however, it is preferred to use a molar excess of the neutralizing acid. Molar ratios of organic carboxylic acid to the compound of formula (III) up to about 6:1, for example from 1.5:1 to 6:1, such as 2:1, 3:1 or 4:1, have been found advantageous in terms of stability and/or softening performance. The use of glycolic in molar excess is especially preferred.

The co-softening ingredient useful in the softening compositions of the invention include glycerol esters, such as, glycerol monostearate and glycerol mono-oleate; sorbitan esters such as sorbitan monostearate, sorbitan tristearate, sorbitan mono-oleate and sorbitan trioleate; and fatty alcohols, such as $C_{16}$–$C_{18}$ fatty alcohols.

The emulsifier used in the present fabric softening compositions is required to stabilize the composition and prevent phase separation and/or an unstable viscosity over a period of at least several months. The fatty alcohol ethoxylates useful in the invention correspond to ethylene oxide condensation products of higher fatty alcohols, with the higher fatty alcohol being of from about 9 to 15 carbon atoms and the number of ethylene oxide groups per mole being from about 10 to 30. In the preferred fatty alcohol ethoxylates for use herein, the alkyl chain length ranges from about 13 to 15 carbon atoms and the number of ethylene groups ranges from about 15 to 20 per mole. Especially preferred for use herein is Synperonic A20 manufactured by ICI Chemicals, such nonionic surfactant being an ethoxylated $C_{13}$–$C_{15}$ fatty alcohol with 20 moles of ethylene oxide per mole of alcohol and having an HLB of 8.25.

Other useful emulsifiers are referred to as EO/PO fatty alcohols available from BASF having the general formula (IV):

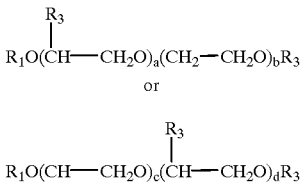

(IV)

wherein $R_1$ is an alkyl group having 8 to 22 carbon atoms; $R_2$ and $R_3$ are $CH_3$ or $CH_2$–$CH_3$; and a, b, c and d are each independently integers from 0 to 30.

Preferred emulsifiers of this type are available from BASF under the tradenames Plurafac LF132 and Plurafac LF231.

Test Methodology

The softening compositions described in the examples below were prepared as follows:

1. The active ingredients are each melted and mixed with stirring and the resulting mixture maintained at 60–65° C.
2. The molten mixture of softening actives is added with stirring to the water phase using a 4-blade "Lightnin" impeller rotating at 300–400 rpm for about 15 minutes.

3. The mixture is then stirred for an additional 10–15 minutes.
4. The emulsion is allowed to cool to 20–25° C.
5. Perfume, where used, is added to the molten mixture just prior to emulsification with the aqueous phase.
6. The sequestrant, if required, (such as Dequest 2000 sold by Solutia) is introduced into the heated water at 60° C.
7. The pH of the composition is adjusted, if necessary, by the addition of a mineral acid such as HCl, or an organic acid, such as citric acid.
8. When preparing highly concentrated compositions containing esterquat (i.e. more than 13% of softening actives, such as, esterquat and fatty alcohol cosoftener) high shear mixing is required in order to reduce the size of the emulsion droplets to the range of 0.2 to 8.0 microns. Suitable high shear mixers for this purpose are High Pressure Homogenizer, or Silverson blade mixer or Ultra Turrax Homogenizer.
9. Adjuvant ingredients such as colorants, preservatives, salts and/or polyelectrolytes are all added with stirring (e.g. 4-pitched blade propeller) into the cold emulsion.

Viscosity of the softening compositions was measured with a Brookfield Viscosimeter Model DV-II operating at 50 rpm. Spindle #2 was used for viscosity measurements below 800 centipoises. Spindle #3 was used for measurements from 800 to 2000 centipoises.

The physical stability of a product is evaluated by ageing tests conducted at 4° C., RT (ambient temperature), 35° C. and 43° C. The presence of gelification and/or phase separation is monitored at the aforementioned temperatures after 2, 4 and 6 weeks.

EXAMPLE 1

Following the test methodology described above, two softening compositions A and B were prepared for comparative purposes in the absence of the fatty alcohol ethoxylate-diurethane polymeric thickener of the invention. The compositions are described in Table 1.

TABLE 1

Fabric Softening Compositions

| Component | A | B |
|---|---|---|
| Amidoamine (Rewopal V3340 - 85% Al) | 4.64% | — |
| Esterquat (Tetranyl AT1-75 - 85% Al) | 2.62 | 3.88 |
| $C_{16-18}$ Fatty Alcohol | — | 0.82 |
| Glycerol mono-oleate (GMO) | 1.00 | — |
| $C_{13-15}$ Fatty alcohol 20EO (Synperonic A20) | — | 0.20 |
| Perfume | 0.64 | 0.32 |
| HCl (25%) | 0.70 | — |
| Blue Colorant | 0.008 | 0.004 |
| Lactic/Lactate Soln (80%) | 0.12 | 0.063 |
| Water | Balance | Balance |
| PRODUCT CHARACTERISTICS | | |
| Total softening ingredients (100% Al) | 7.30% | 4.10% |
| Final pH | 2.8 | 2.5 |

5 To each of compositions A and B there was added increasing levels of BASF polymer #71496, a polymeric thickener in accordance with the invention. Product viscosities were then measured at RT, one day after making, using a Brookfield Viscosimeter. The results are shown in Table 2.

TABLE 2

Viscosity of Softening Compositions with Varying Levels of Polymer

| % BASF 71496 Polymer | Viscosity (Centipoises) A | B |
|---|---|---|
| 0.00 | 22 | 31 |
| 0.12 | 71 | — |
| 0.20 | — | 117 |
| 0.25 | 112 | — |
| 0.30 | — | 163 |
| 0.40 | — | 270 |
| 0.50 | 350 | — |

Based on the data above, each of compositions A and B was thickened by the addition of the diurethane polymer of the invention. The viscosity achieved was directly related to the level of polymer added to the composition.

EXAMPLE 2

The purpose of this Example was to measure the effect of product pH on the thickening performance of the diurethane polymer of the invention in a softening composition of the invention. Comparative composition B described in Example 1 had a final product pH of 2.5. Using a 10% hydrochloric acid solution to adjust the product pH, several samples of composition B were adjusted, respectively to pH values of 2.3; 2.0; and 1.8. To each of such pH-adjusted samples, BASF polymer 71496 was introduced at a level of 0.3% (as is) (0.075% active material) to form fabric softening compositions of the invention. The product viscosity was measured the day after making and again after 2 and 6 weeks of storage at RT. Product stability was evaluated over a 6 week period of storage at 4°, RT, 35° and 43°. The results are shown in Table 3.

TABLE 3

Thickening Performance of BASF #71496 Polymer versus pH of Softening Composition B

| | | Composition B | | | | | |
|---|---|---|---|---|---|---|---|
| pH | | 2.5 | 2.5 | 2.3 | 2.0 | 1.8 | 1.8 |
| BASF polymer (wt. %) | | 0.0 | 0.3 | 0.3 | 0.3 | 0.3 | 0.0 |
| Product Characteristic | | | | | | | |
| Viscosity[1] (cps) | 1 day | 31 | 163 | 257 | 270 | 394 | 38 |
| | 2 weeks | 32 | 145 | 217 | 304 | 435 | 52 |
| | 6 weeks | 33 | 138 | 200 | 293 | 408 | 66 |
| Product stability at 6 weeks | | O.K. | O.K. | O.K. | O.K. | O.K. | O.K. |

[1]Viscosity measurements were conducted on products stored at RT.

Based on the data in Table 3, the BASF diurethane polymer is seen to provide an increased thickening effect as the pH of the softening composition decreases. In the absence of the polymer (at 0.0 wt. %) no significant thickening effect was noted as the pH of composition B decreased. Accordingly, it is believed that the polymers of the invention are effective thickeners for softening compositions formulated at acid pH conditions.

EXAMPLE 3

Following the procedure of Example 2 a comparative experiment was conducted to measure the thickening properties and product stability which result from the use of a commercially available associative polymer, Rheolate 255 manufactured by Rheox Inc., which is not in accordance with the invention, in place of the BASF polymer used in Example 2. A 10% hydrochloric acid solution was used to adjust the product pH to values of 2.5 and 2.3, respectively, after the dispersion of 0.075 wt. % of active material of both of the individual polymers into samples of the comparative base composition B. Product viscosity was measured at RT one day after making of the product. Product stability was judged over a 6 week period of storage of the respective samples at 4°, RT, 35° and 43° C. The results are shown in Table 4.

TABLE 4

Comparative Thickening Performance of BASF and Rheolate Polymers versus pH of Softening Composition B

| | Base Composition B | | | |
|---|---|---|---|---|
| | BASF Polymer | | Rheolate Polymer | |
| pH | 2.5 | 2.3 | 2.5 | 2.3 |
| Viscosity (cps) at RT 1 day | 163 | 257 | 356 | 332 |
| Product stability at 6 weeks | OK | OK | Phase[1] Separation | Phase[1] Separation |

[1]Phase separation was noted after 2 weeks storage at 35° and 43° C.

[1] Phase separation was noted after 2 weeks storage at 35° and 43° C.

Based on the data of Table 4 it is seen that the composition of the invention containing the BASF polymer remained stable at low pH conditions unlike the comparative softening composition thickened with a conventional associative polymer.

EXAMPLE 4

The purpose of this example was to compare the performance of a polymeric thickener of the invention (BASF 71496) in a highly concentrated composition versus the performance of a swelling cross-linked polymer of the prior art (BP #7050 polymer ex BP Chemical).

A base composition (Base C) was prepared according to the test methodology described above consisting of 15.53 wt % esterquat (Tetranyl AT1-75), 3.3 wt % $C_{16-18}$ fatty alcohol, 1.28 wt % of a fragrance, 0.25 wt % of a lactic/lactate solution (80% active), 0.1 wt % Dequest 2000, 0.016 wt % of a colorant (Liquint Royal blue ex Milliken) and water to balance. As required for highly concentrated product, the base composition was subjected to high shear on a High Pressure Homogenizer (HPH).

To the Base Composition C, there was added BASF #71496 at a level of 0.15 wt %. Product viscosity was measured at RT one day after making the product. Product stability was judged over a 6-week period of storage at 4°, RT, 35° and 43° C.

For purpose of comparison, BP#7050 thickener manufactured by BP Chemical was added at the level of 0.23 wt % to the same base composition. Product viscosity and stability were recorded as described above.

The results are shown in Table 5.

TABLE 5

Comparative Thickening Performance of BASF #71496 Polymer and Prior Art Polymer in Highly Concentrated Product

| | Base Composition C | |
|---|---|---|
| | 0.15 wt % BASF 71496 | 0.23 wt % BP #7050 |
| pH | 2.6 | 2.6 |
| Viscosity (cps) at RT 1 day | 1 76 | 204 |
| Product stability at 6 weeks | OK | Phase Separation[1] |

[1]Phase separation was noted after 4 weeks at RT and 35° C.

Based on the data of Table 5, it is noted that the concentrated composition of the invention remained stable over the entire test period even at elevated temperature while the comparative softening composition using a conventional polymeric thickener evidenced a phase separation after 4 weeks of aging at ambient temperature.

What is claimed is:

1. A stable, pourable and water dispersible liquid fabric softening composition comprising:

(a) from about 2% to about 25%, by weight, of one or more fabric softening compounds selected from the group consisting of quaternary ammonium compounds and amine compounds wherein said quaternary ammonium compound is a biodegradable fatty ester quaternary ammonium compound of formula (II)

(II)

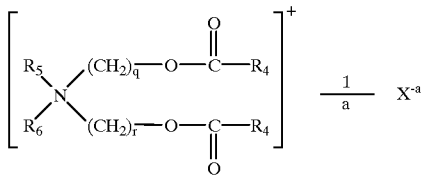

wherein each $R_4$ independently represents an aliphatic hydrocarbon group having from 8 to 22 carbon atoms, $R_5$ represents $(CH_2)_s$–$R_7$ where $R_7$ represents an alkoxy carbonyl group containing from 8 to 22 carbon atoms, benzyl, phenyl, $(C_1$–$C_4)$-alkyl substituted phenyl, OH or H;

$R_6$ represents $(CH_2)_tR_8$ where $R_8$ represents benzyl, phenyl, $(C_1$–$C_4)$ alkyl substituted phenyl, OH or H;

q, r, s and t, each independently, represent a number of from 1 to 3: and x is an anion of valence a;

(b) from 0% to about 10% of a co-softening ingredient selected from the group consisting of glycerol esters, sorbitan esters and fatty alcohols;

(c) from about 0.02% to about 3%, by weight, of a fatty alcohol ethoxylate-diurethane polymer having the structure of formula (I): (I)

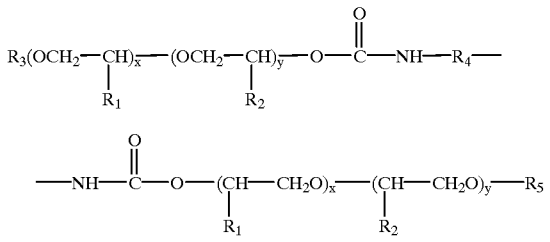

wherein $R_1$ and $R_2$ are independently H, methyl or ethyl; x and y are integers from 0 to 250 with the proviso that x+y is no greater than 250; $R_3$ and $R_5$ are each independently an alkyl or an alkenyl group having from 8 to 24 carbon atoms; and $R_4$ is a linear or branched alkyl, cycloalkyl or aryl group having from 2 to 16 carbon atoms;

(d) from 0% to about 15%, by weight, of an organic or inorganic acid;

(e) from 0% to about 3%, by weight, of an emulsifier selected from the group consisting of alkoxylated fatty alcohols;

(f) from 0% to about 7%, by weight, of one or more adjuvant materials; and (g) balance water, wherein the viscosity of said liquid fabric softening composition is significantly higher than the viscosity of an otherwise identical softening composition but which does not contain the polymer component (c).

2. The fabric softening composition of claim 1 wherein $R_7$ is OH and $R_5$ is hydroxyethyl, $R_6$ is methyl, q, r and s are each 2, and t is 1.

3. The fabric softening composition of claim 1 wherein $R_4$ in the diurethane polymer of component (c) is a linear alkyl group having 2 to 10 carbon atoms.

4. The fabric softening composition of claim 3 wherein $R_3$ and $R_5$ in the said diurethane polymer each have independently from 12 to 18 carbon atoms.

5. A method of imparting softness to fabric comprising contacting the fabrics with a softening effective amount of the fabric softening composition of claim 1.

6. The method of claim 5 wherein said contacting occurs in the rinse cycle of an automatic laundry washing machine.

* * * * *